US011613969B2

(12) United States Patent
Koli et al.

(10) Patent No.: US 11,613,969 B2
(45) Date of Patent: Mar. 28, 2023

(54) SKIVE CUT BOREHOLE SCREEN END RING METHOD OF USE

(71) Applicant: Baker Hughes Holdings LLC, Houston, TX (US)

(72) Inventors: Jai K. Koli, Houston, TX (US); Christopher Malbrel, Houston, TX (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 75 days.

(21) Appl. No.: 17/145,565

(22) Filed: Jan. 11, 2021

(65) Prior Publication Data

US 2021/0215022 A1 Jul. 15, 2021

Related U.S. Application Data

(63) Continuation-in-part of application No. 15/655,472, filed on Jul. 20, 2017, now abandoned.

(51) Int. Cl.
*E21B 43/08* (2006.01)

(52) U.S. Cl.
CPC ..... *E21B 43/088* (2013.01)

(58) Field of Classification Search
CPC ..... E21B 43/08; E21B 43/088
See application file for complete search history.

(56) References Cited

U.S. PATENT DOCUMENTS 4,278,277 A 7/1981 Krijgsman
4,488,595 A 12/1984 Akkerman
4,840,379 A 6/1989 Thoman
5,131,666 A 7/1992 Hutchins
5,611,399 A 3/1997 Richard et al.
5,881,812 A 3/1999 Malbrel
6,305,468 B1 10/2001 Broome et al.
6,478,092 B2 11/2002 Voll et al.
6,607,032 B2 8/2003 Voll et al.
8,127,447 B2 3/2012 Peterson
8,267,169 B2 9/2012 Moen
9,416,634 B2 8/2016 Olenick et al.
2005/0225037 A1 10/2005 Dove
2011/0180257 A1* 7/2011 Scott ..... E21B 43/084 166/228
2012/0037357 A1* 2/2012 Lopez ..... E21B 43/088 29/505
2013/0000890 A1* 1/2013 Olenick ..... E21B 43/084 140/3 R
2013/0180733 A1* 7/2013 Bradshaw ..... F16J 15/166 83/13
2019/0024486 A1 1/2019 Koli et al.
2020/0095833 A1 3/2020 Koli et al.

FOREIGN PATENT DOCUMENTS

EP 1690580 A1 8/2006

OTHER PUBLICATIONS

Notification of Transmittal of the International Search Report and Written Opinion; PCT/US2022/011557; Korean Intellectual Property Office; dated Jan. 7, 2022; 10 pages.

* cited by examiner

*Primary Examiner* — Blake Michener
*Assistant Examiner* — Yanick A Akaragwe
(74) *Attorney, Agent, or Firm* — Cantor Colburn LLP

(57) ABSTRACT

A method of assembling a borehole screen assembly includes placing a screen around a base pipe followed by an end ring having a skive cut to allow fitment with the screen by sliding along the skive cut. The assembly can be completed with welds.

12 Claims, 3 Drawing Sheets

SKIVE CUT BOREHOLE SCREEN END RING METHOD OF USE

BACKGROUND OF THE INVENTION

1. Field of the Invention

The invention relates generally to screen construction for borehole use and more particularly end rings with a skive cut to allow fitment over a screen assembly built on base pipes with variable external dimension that further feature an end radial section directed toward the base pipe for welding the end ring to the base pipe.

2. Description of the Related Art

Screens are used in borehole operations to control produced solids from the formation and to enable inflow through a surrounding pack of filtration material referred to as gravel when producing the formation. One common design used for such purposes is known as a wire wrap screen. In essence, a wire that has a round or a triangular cross-section with the flat side oriented outwardly is wrapped over a base pipe that features axially extending support members spaced about the periphery. The base pipe is perforated under the wire wrap to allow the produced fluid to enter a tubing string, a part of which is formed by the base pipe.

The ends of the screen assembly need to be closed and this is done with end ring assemblies that are fitted around the base pipe and overlap the screen jacket and are welded or otherwise secured to a base pipe. Some examples of such designs are shown in U.S. Pat. Nos. 8,267,169; 8,127,447; 5,611,399; 6,305,468; 6,607,032 and 6,478,092. One issue with assembling a variety of screens to meet different conditions is variation of screen jacket diameter due to tolerances of base pipe OD, wire dimensions and rib and wrap penetration. Typically, the end rings or end ring assemblies had to be stocked in a variety of internal dimensions due to these tolerances. Additionally, the end ring assembly could involve a base ring secured to the base pipe and an overlapping ring that went over an end of the screen jacket that was separately welded to the base ring secured around the outside of the base pipe. These overlapping rings could be machined for a specific design and shrink fitted into position over the screen jacket. Welding the overlapping ring to the screen jacket also created risks of screen gage openings that required manual correction which was not favored by the end user.

A compromise to address the dimensional variation of the screen assembly due to base pipe and other sections' dimensional variations involved using two adjacent rings. The end ring was still custom machined for the application and the overlapping ring was skive cut to fit over the screen jacket. After fitting the overlapping ring and welding the skive cut in the overlapping ring, the overlapping ring had to be welded to the custom machined end ring which was, in turn, welded to the base pipe. Skive cuts in ring shaped objects are described in US 2005/0225037 and U.S. Pat. No. 4,840,379.

SUMMARY OF THE INVENTION

The present invention seeks to improve the manufacturing process, particularly for screens for borehole use, and in the process reduce manufacturing costs by using an end ring that combines a radial section that fits over the base pipe with an overlapping section that spans over the screen outer jacket while incorporating a skive cut in the ring. This construction maintains a sand tight gap and allows a close fit of the overlapping section and allows the radial section to maintain a sufficiently small gap to the base pipe to allow closure with welding. With the skive cut through both sections, the internal dimensions of the overlapping section can be modified to get a snug fit at the screen outer diameter and the skive cut then welded to hold the desired dimension.

A borehole screen such as the one with a wire wrap/slip on screen on a base pipe with variable external dimensions features an end ring that is one piece with a skive cut to allow fitment over a screen jacket that covers the wire wrap. The end ring has a cylindrically-shaped section to go over the screen jacket and a radial section at one end oriented toward the base pipe. Relative sliding of angle cut ends along the skive cut gets the desired dimension of the inner diameter of the cylindrical component of the end ring over the screen jacket to control sand inflow followed by the skive cut being sealed with a weld. As the ends are slid along the skive cut, the body of the end ring is slightly skewed out of its plane. The radial section is attached to the base pipe with a second weld such that two welds complete the end assembly for the borehole screen. At the time the second weld is applied, the end ring is preferably not in contract with the base pipe.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein:

FIG. 3 illustrates the skive cut and angle cut ends of the end ring before adjustment of its inner diameter.

DETAILED DESCRIPTION OF THE PREFERRED EMBODIMENTS

Figure 1:
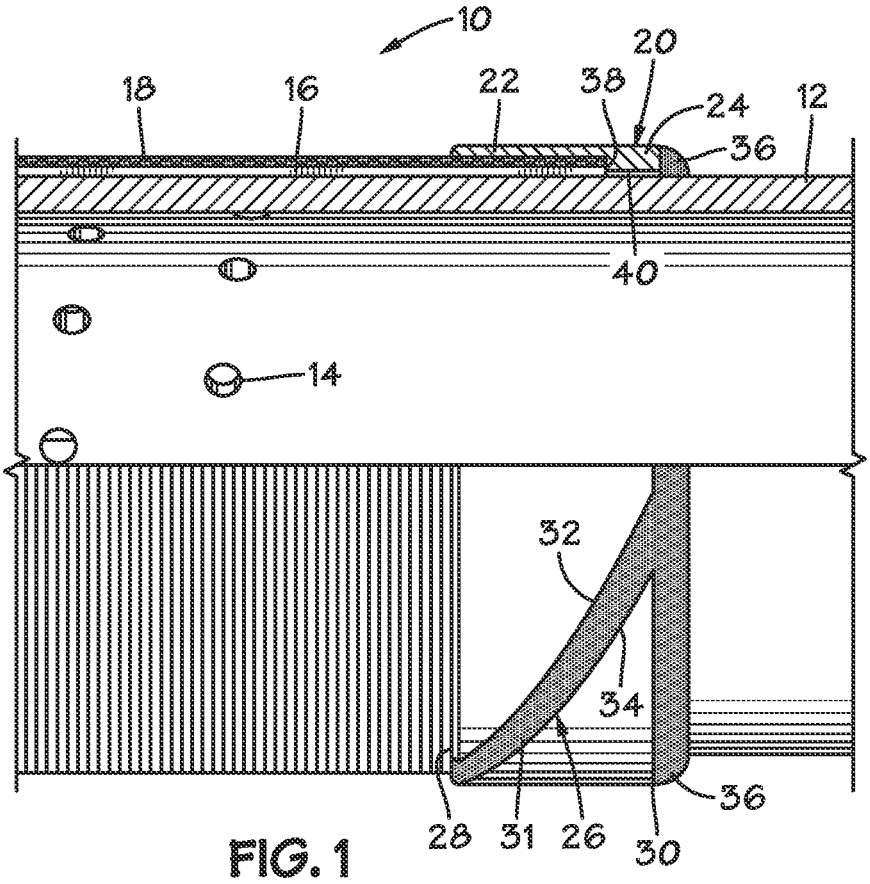
FIG. 1 is a side, cross-sectional view of an exemplary end ring constructed in accordance with the present invention in placed around an exemplary screen assembly.
Figure 2:
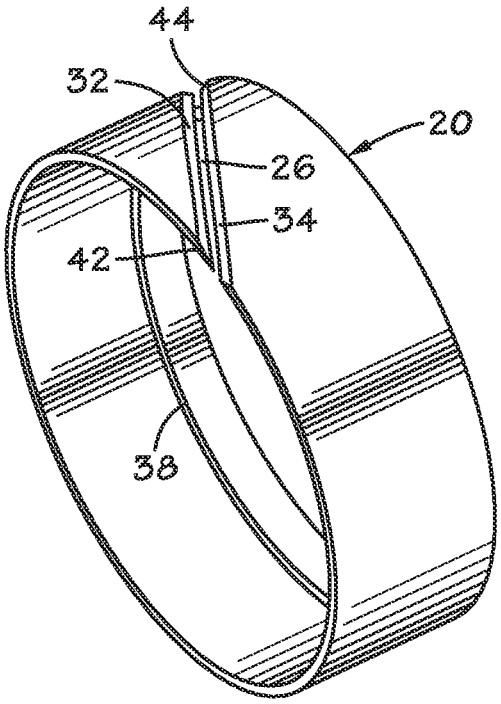
FIG. 2 is an isometric view of the exemplary end ring of FIG. 1.

FIG. 1 shows an exemplary screen assembly 10 which includes a base pipe 12 with openings 14. A series of axially oriented and circumferentially-spaced support ribs 16 are covered with a wrapped wire 18 to create a screen or screen jacket. The wire 18 can have a circular or triangular cross-section, for example. If a triangular cross-section is used, a flat side of each triangle is outwardly oriented and a point of the triangle is oriented toward the base pipe 12.

An end ring 20 has a cylindrical section 22 overlapping the wrapped wire 18. The end ring 20 is preferably of single piece (one-piece) construction. In some cases, the wrapped wire 18 is covered with an outer jacket (not shown) for protection of the wrapped wire during running in and use. A radial section 24 extends integrally from an end of the cylindrical section 22 toward the base pipe 12. A skive cut 26 extends at an angle from end 28 of the cylindrical section 22 to end 30 of the radial section 24. The skive cut 26 is typically a cut made at an approximate 45-degree angle to the axis of the end ring 20 and which may be straight or slightly curved. In essence, the end ring 20 is a split ring that can be opened at the skive cut 26 to be placed over the base pipe 12, support ribs 16 and wrapped wire 18. The skive cut 26 can be closed with ends 32 and 34 abutting one another. The radial section 24 presents an interior surface 40 which is the point of the radial section 24 which extends furthest radially inward toward the base pipe 12. It is noted that each angle cut end 32, 34 terminates in an end point 42 and 44, respectively. The ends 32 and 34 may be slid relatively along the skive cut 26 in order to adjust the internal diameters of the end ring 20. This adjustment is made as the end ring 20 is being placed on to the base pipe 12 and wrapped wire 18.

FIG. 1 shows an instance in which the end ring assembly 20 is fit around wrapped wire 18 which has an outer diameter that is essentially the same as the inner diameter of the end ring 20 (at the overlapping section) so that no adjustment is necessary prior to applying a weld bead 31 along the skive cut 26. The end ring 20 will fit properly when the cylindrical section 22 of the end ring 20 is brought into snug contact against the wrapped wire 18 screen so that entry of sand between the wrapped wire screen 18 and end ring 20 (at section 22) is prevented. The welds 31 and 36 also prevent entry of sand.

Figure 4:
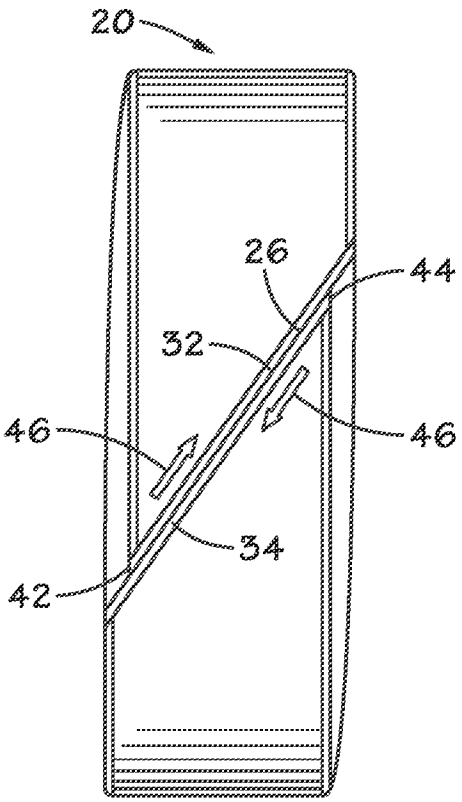
FIG. 4 illustrates adjustment of end ring fitment by sliding angle cut ends along the skive cut to accommodate a base pipe of a larger diameter.

FIG. 3 shows the end ring 20 in a default condition prior to an adjustment of its inner diameter. FIG. 4 illustrates a situation wherein the ends 32 and 34 are moved relative to one another along the skive cut 26 in order to accommodate wrapped wires of a slightly larger diameter. Adjustment is illustrated by the arrows 46 wherein the end points 42, 44 of the ends 32, 34 are moved towards one another along the skive cut 26 thereby enlarging the internal diameter of the end ring 20. As discussed herein, sliding along the skive cut refers to a relative movement of the ends 32, 34 when the ends 32, 34 remain in contact or closely adjacent one another such that the ends 32, 34 can be readily sealed together with a weld bead. As will be appreciated by reference to the Figures, movement of the ends 32, 34 along the skive cut 26 will result in the body of the ring 20 being skewed or slightly twisted out of plane.

Figure 5:
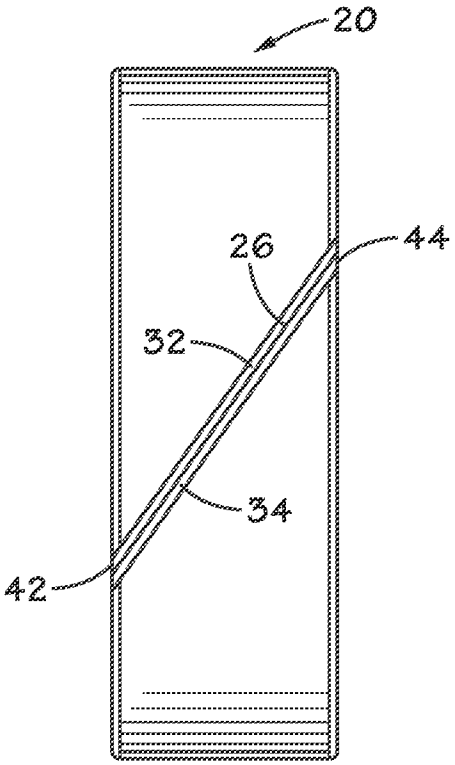
FIG. 5 illustrates adjustment of end ring fitment by sliding angle cut ends along the skive cut to accommodate a base pipe of a smaller diameter.
Figure 5:
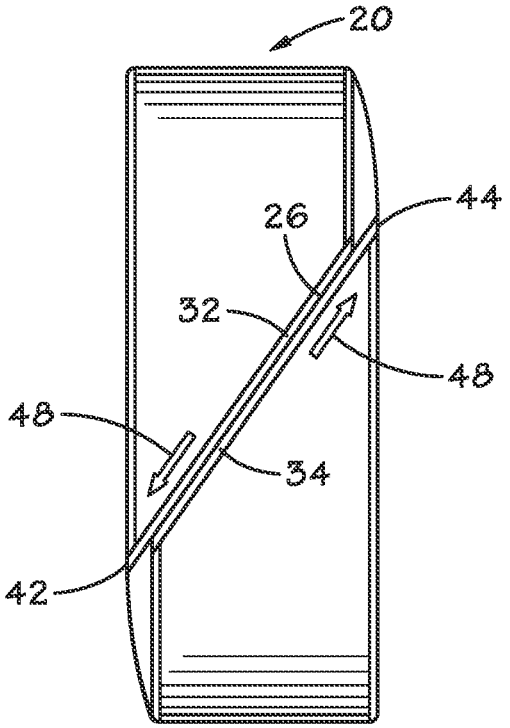

FIG. 5 illustrates a situation wherein the ends 32 and 34 are moved relative to one another along the skive cut 26 in order to accommodate wrapped wires of a slightly smaller diameter. Adjustment is illustrated by the arrows 48 wherein the end points 36, 38 are moved away from one another along the skive cut 26, thereby reducing the internal diameter of the end ring 20. Because the ends 32 and 34 lie adjacent one another after adjustment, one can still weld the ends together along the skive cut 26. When the desired fit over the wire wrap 18 and the overlying screen jacket is achieved with relative movement between the angle cut ends 32, 34, the skive cut 26 is then welded together (31) followed by a weld 36 that is circumferential at end 30 to secure the end ring 20 to the base pipe 12.

While the radial height of the radial section is fixed, the internal diameter of the end ring 20 is variable. Since the dimensions of the support ribs 16 and the wrapped wire 18, along with any jacket that covers the wrapped wire 18 are typically well known and not subject to dimensional variability, an undercut 38 is made to allow the cylindrical section 22 to fit snugly against the wire wrap 18 and a surrounding jacket as the inside diameter is varied with relative sliding movement of ends 32 and 34 until the inside surface 40 of the radial section lies proximate the base pipe 12. Typically, there will be a small gap, as shown in FIG. 1, between the inner surface 40 of the end ring 20 and the base pipe 12. At this point, the skive cut 26, which now has its gap nearly or completely closed, can be welded between ends 28 and 30. When the skive cut 26 is welded after relative sliding movement of ends 32 and 34, the weld 36 can be put down and the screen assembly 10 is completed at one end. The inner surface 40 of the end ring is typically not in contact with the base pipe 12 as the weld 36 is applied. The same procedure can be applied at an opposite end of the screen assembly 10.

The end ring 20 and its method of use in construction of screen assemblies provide advantages over a two-piece end ring system which requires more welding and still needs customer machining or a large end ring inventory as the cylindrical section is fitted over the screen and outer jacket assembly. Instead, a single integrated design allows variability so that the cylindrical section 22 of the end ring 20 can be adjusted to provide a sand tight gap fitment against the screen formed by the wrapped wire 18 while allowing some variation in the distance between the inner surface 40 of the radial section 24 and the base pipe 12. With the ability to make relative axial movements by sliding along the skive cut, the desired dimension is obtained around the base pipe and an undercut offering a snug fit to the screen assembly is obtained at the same time. A skive cut weld and a circumferential weld to the base pipe of the radial section completes the operation.

What is claimed is:

1. A method of assembling a borehole screen assembly, the method comprising:

placing a screen around a base pipe to form the borehole screen assembly;

overlaying an end ring over the borehole screen assembly, the end ring having a skive cut which forms two angle cut ends;

each of the angle cut ends presents an end point;

adjusting an internal diameter of the end ring by sliding the angle cut ends of the end ring along the skive cut while maintaining contact between the angle cut ends; and welding only both of along the skive cut and along the end ring to the base pipe.

2. The method of claim 1 wherein the step of adjusting the internal diameter of the end ring further comprises moving the angle cut ends so that the end points of each angle cut end are moved away from each other.

3. The method of claim 1 wherein the step of adjusting the internal diameter of the end ring further comprises moving the angle cut ends so that the end points of each angle cut end are moved toward each other.

4. The method of claim 1 wherein the placing of the screen around the base pipe includes creating the screen by wrapping a wire around the base pipe.

5. The method of claim 1 wherein the step of adjusting the interior diameter of the end ring further comprises bringing a cylindrical component of the end ring into contact the screen to seal off sand entry between the base pipe and the screen.

6. The method of claim 1 wherein:

the end ring includes a cylindrical section which overlies the screen and a radial section which extends radially inwardly from the cylindrical section; and the step of adjusting the internal diameter of the end ring provides a sand tight gap between the cylindrical section and the screen.

7. The method of claim 6 wherein:

the radial section presents an inner surface; and wherein the inner surface is not in contact with the base pipe when the end ring is welded to the base pipe.

8. A method of assembling a borehole screen assembly, the method comprising:

placing a screen around a base pipe to form the borehole screen assembly;

overlaying a one-piece end ring over the borehole screen assembly, the end ring having a skive cut which forms two angle cut ends;

each of the angle cut ends presents an end point;

adjusting an internal diameter of the end ring by sliding the angle cut ends of the end ring along a skive cut while maintaining contact between the angle cut ends; and welding only both of along the skive cut and along the end ring to the base pipe.

9. The method of claim 8 wherein the step of adjusting the internal diameter of the end ring further comprises moving the angle cut ends so that the end points of each angle cut end are moved away from each other to reduce the internal diameter.

10. The method of claim 8 wherein the step of adjusting the internal diameter of the end ring further comprises moving the angle cut ends so that the end points of each angle cut end are moved toward each other to increase the internal diameter.

11. The method of claim 8 wherein placing the screen includes forming the screen by overlaying the base pipe with a plurality of axially oriented and circumferentially-spaced support ribs; and wrapping a wire around the ribs to create the screen.

12. The method of claim 8 wherein:

the end ring includes a cylindrical section which overlies the screen and a radial section which extends radially inwardly from the cylindrical section;

the radial section presents an inner surface; and the inner surface is not in contact with the base pipe when the end ring is welded to the base pipe.

* * * * *